US006450841B1

(12) United States Patent
Oyamada

(10) Patent No.: US 6,450,841 B1
(45) Date of Patent: Sep. 17, 2002

(54) CONNECTOR STRUCTURE HAVING A RETAINER WITH A PROVISIONAL RETAINING FUNCTION

(75) Inventor: Shigeru Oyamada, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/944,176

(22) Filed: Sep. 4, 2001

(30) Foreign Application Priority Data

Sep. 4, 2000 (JP) ..... 2000-266713

(51) Int. Cl.[7] ..... H01R 13/514
(52) U.S. Cl. ..... 439/752
(58) Field of Search ..... 439/752, 599

(56) References Cited

U.S. PATENT DOCUMENTS 4,946,398 A * 8/1990 Takenouchi et al. ..... 439/599
5,004,436 A * 4/1991 Aoyama ..... 439/752
5,292,261 A * 3/1994 Hirano et al. ..... 439/752

FOREIGN PATENT DOCUMENTS

JP 2-172167 * 7/1990

* cited by examiner

*Primary Examiner*—Neil Abrams
*Assistant Examiner*—Javaid Nasri
(74) *Attorney, Agent, or Firm*—Sughrue Mion, PLLC

(57) ABSTRACT

A retainer guide groove having guiding faces which are in parallel with a direction of inserting the retainer into a connector housing and opposed to each other is formed in an inner side face of a side wall of the connector housing. A retainer insertion direction restricting arm having guided faces is formed in the retainer. The guided faces are guided in the retainer guide groove while being respectively in sliding contact with the opposing guiding faces of the retainer guide groove when the retainer is to be inserted into the connector housing. A terminal engagement portion is disposed in the retainer. The terminal engagement portion prevents a connecting terminal which is provisionally inserted into the terminal housing chamber of the connector housing when the retainer is provisionally positioned with respect to the connector housing, from slipping off from the terminal housing chamber.

3 Claims, 6 Drawing Sheets

CONNECTOR STRUCTURE HAVING A RETAINER WITH A PROVISIONAL RETAINING FUNCTION

BACKGROUND OF THE INVENTION

1. Field of the Invention

The present invention relates to a terminal engagement structure for a connector in which, in a connector employing a retainer that is used for connecting electric paths such as a wire harness, a provisional insertion state of a connecting terminal inserted into the connector housing can be ensured particularly in a state where the retainer is provisionally engaged with the connector housing.

2. Description of the Related Art

Conventionally, a connector which is used for connecting electric paths such as a wire harness interconnecting electrical appliances in an automobile has a structure wherein connecting terminals are inserted into a connector housing to which a retainer (engagement member) is fittingly held in a provisional engagement (preset) state, and the retainer which is provisionally engaged with the connector housing is then completely inserted into the connector housing to prevent the connecting terminals from slipping off therefrom. Such a connector is disclosed in, for example, JP-A-2-172167.

As shown in FIG. 10, for example, the connector of the conventional art comprises: a connector housing 2 having a plurality of terminal housing chambers 1; a plurality of engagement arms 3 which are to be respectively inserted into the terminal housing chambers 1; and a retainer (engagement member) 6 in which openings 4 for inserting connecting terminals, and claws 5 for engagement with the connector housing 2 are formed. The connector has the following initial configuration. As shown in FIG. 11, the retainer 6 is set into the connector housing 2 to a preset state. In a step of attaching connecting terminals 7, the connecting terminals 7 are inserted through the openings 4 of the retainer 6 which is preset, toward the interior of the terminal housing chambers 1 of the connector housing 2, and the retainer 6 is then further inserted into the connector housing 2, whereby the retainer 6 is engaged with the connecting terminals 7.

In the thus configured connector, however, the retainer 6 lacks a direction regulation margin (regulating face) for regulating the direction of inserting the retainer toward the interior of the connector housing 2, and hence the direction of inserting the retainer into the connector housing 2 is not stable. When the retainer 6 is inclinedly inserted into the connector housing 2 as indicated by the chain lines in FIG. 11, therefore, this inclination causes the tip ends of the engagement arms 3 and the respective connecting terminals 7 to be misaligned in engagement position, so that the retainer 6 is unstably engaged with the connecting terminals 7. As a result, sometimes, there arise troubles such as that connecting terminals which have been once inserted cannot be easily pulled out.

In order to solve such troubles, it may be contemplated to, in both the connector housing 2 and the retainer 6, prolong the margin for fitting (contacting face) which elongates in the retainer insertion direction to restrict the inclination during a process of inserting the retainer 6. When the margin for fitting in the retainer insertion direction is set to be long, however, there arises another trouble that the overall shape of the connector becomes large.

SUMMARY OF THE INVENTION

The invention has been made in view of the abovementioned conventional art. It is an object of the invention to provide a connector in which a retainer that is to be inserted into a connector housing is structured so as to be insertable in parallel with the direction of the insertion axis of the connector housing, thereby enhancing the reliability of the connector terminal engagement by the retainer, and preventing the connector housing from being enlarged, to make the connector compact.

In order to attain the object, according to one aspect of the invention, in a terminal engagement structure for a connector having: a connector housing in which one or more terminal housing chambers are formed, one or more connecting terminals to be respectively inserted into the terminal housing chambers; and a retainer which is insertable in a same direction as a connector terminal insertion direction in the connector housing, and which is positionable at a provisional engagement position and a regular engagement position with respect to the connector housing, a retainer guide groove having guiding faces is formed in an inner side face of a side wall of the connector housing, the guiding faces being in parallel with the direction of inserting the retainer into the connector housing, and opposed to each other, a retainer insertion direction restricting arm having guided faces is formed in the retainer, the guided faces being guided in the retainer guide groove while being respectively in sliding contact with the opposing guiding faces of the retainer guide groove when the retainer is to be inserted into the connector housing, and a terminal engagement portion is disposed in the retainer, the terminal engagement portion preventing a connecting terminal which is provisionally inserted into the terminal housing chamber of the connector housing when the retainer is provisionally positioned with respect to the connector housing, from slipping off from the terminal housing chamber.

According to this configuration, when the retainer is to be inserted into the connector housing, the retainer insertion direction is restricted so as to be in parallel with the axial direction of the connector housing by the retainer guide groove and the retainer insertion direction restricting arm. Therefore, the engagement function between the retainer and the connecting terminal which is inserted to the provisional engagement position in the connector housing can be ensured.

DETAILED DESCRIPTION OF THE PRESENT INVENTION

Hereinafter, a preferred embodiment of the invention will be described in detail with reference to the accompanying drawings.

Figure 1:
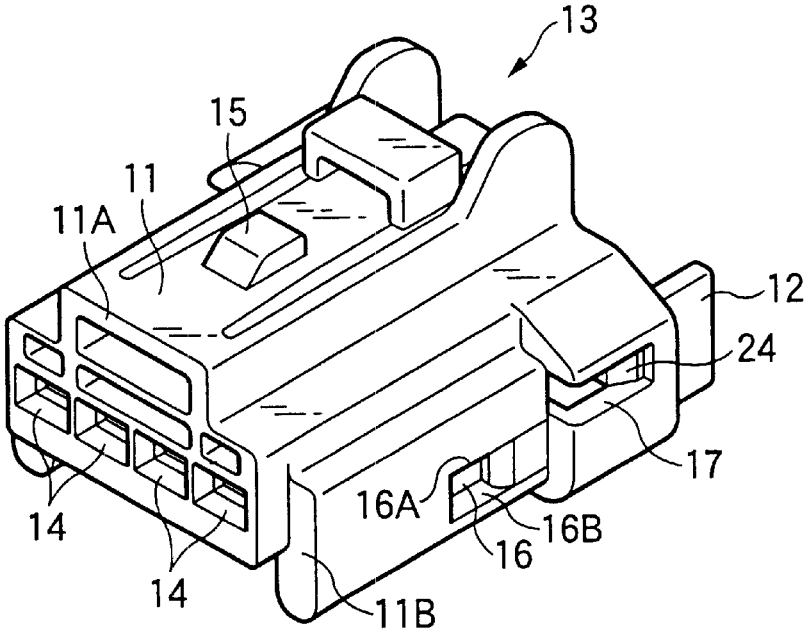
FIG. 1 is a perspective view showing an embodiment of a connector structure according to the invention.
Figure 2:
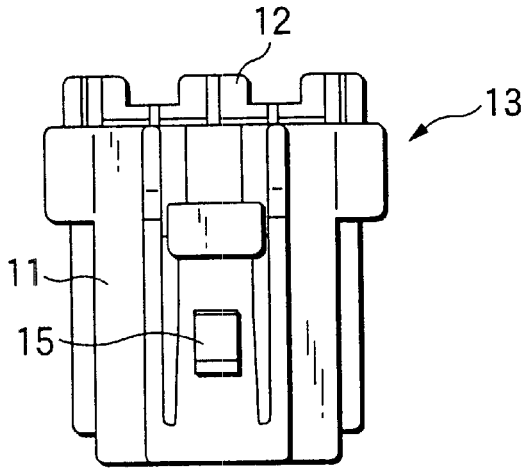
FIG. 2 is a plan view showing the embodiment of the connector structure according to the invention.
Figure 3:
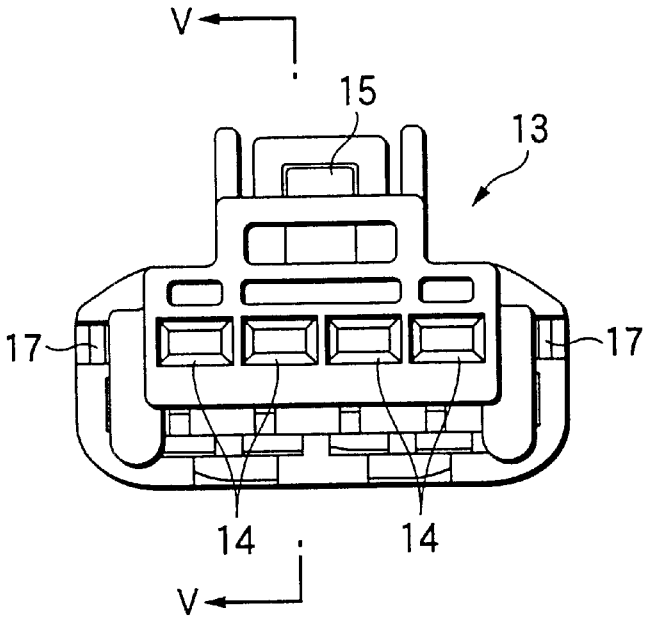
FIG. 3 is a front view showing the embodiment of the connector structure according to the invention.

FIG. 1 shows a connector 13 comprises a connector housing 11 and a retainer 12 combined with the connector housing 11, and both are made of a resin. First, the configuration of the connector housing 11 will be described. The connector housing 11 is formed into an approximately rectangular tubular shape. A plurality of (in the embodiment, four) terminal housing chambers 14 are juxtaposed in parallel in the connector housing. An engagement portion 15 for maintaining fitting with a counter connector housing which is not shown is disposed on the outer face of an upper wall portion 11A of the connector housing 11.

A retainer guide groove 16 is formed in the inner face of each of the right and left side wall portions 11B of the connector housing 11. Each of the retainer guide grooves is formed from the opening on the retainer insertion side of the connector housing so as to elongate toward the interior of the connector housing 11, and parallel with the axis x of each terminal housing chamber 14.

Each of the retainer guide grooves 16 has parallel guiding faces 16A and 16B which are opposed to each other. In each of the right and left side wall portions 11B, a provisional engagement groove 17 for provisionally positioning the retainer is formed in the vicinity of the opening face on the retainer insertion side.

Figure 6:
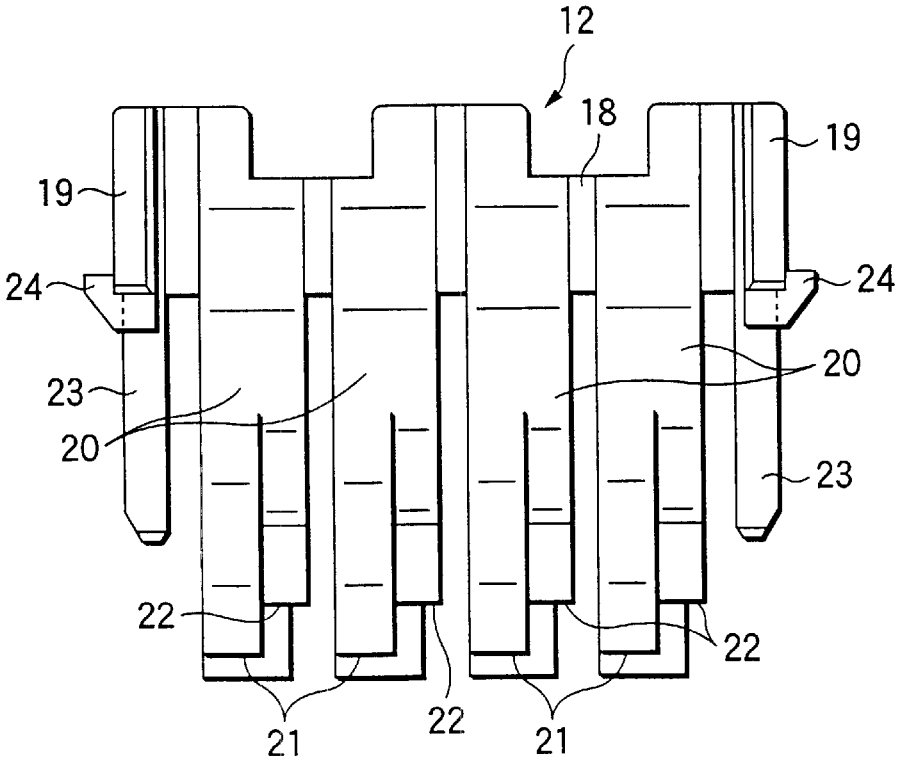
FIG. 6 is a plan view of a retainer which is used in the invention.
Figure 7:
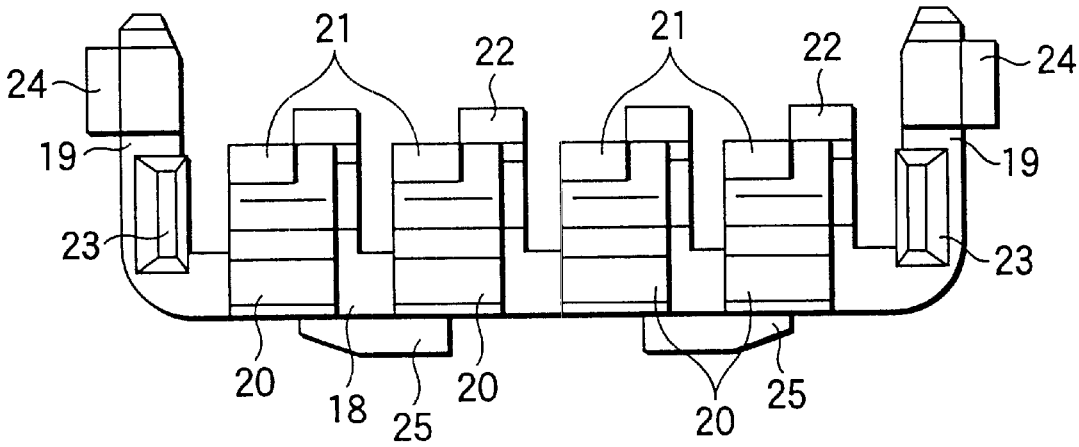
FIG. 7 is a front view of the retainer which is used in the invention.
Figure 8:
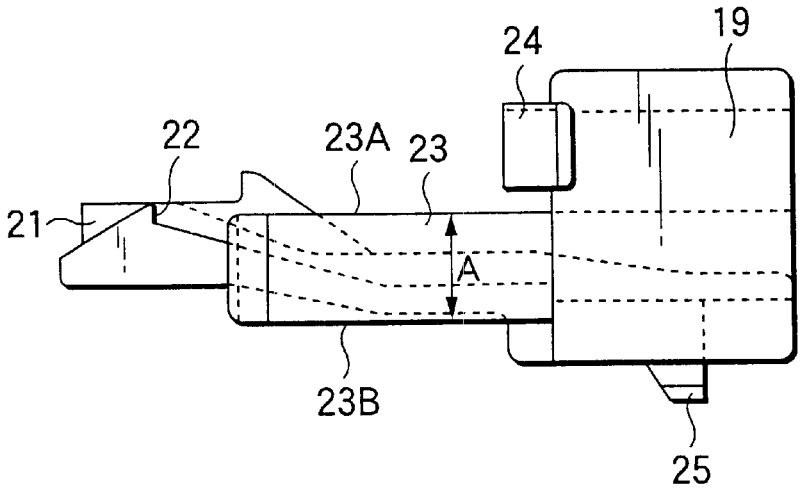
FIG. 8 is a plan view of the retainer which is used in the invention.

Next, the configuration of the retainer 12 will be described with reference to FIGS. 6 to 8. The retainer 12 has a bar portion 18 which is lateral as seen from the front, and rising portions 19 which rise from the lateral side ends of the lateral bar portion, respectively. Flexible engaging pieces 20 which project so as to, when the retainer 12 is to be fitted into the connector housing 11, be respectively inserted into the terminal housing chambers 14 of the connector housing 11 are formed in parallel on the lateral bar portion 18.

A terminal engagement portion 21 and a regular terminal engagement portion 22 are formed on a tip end portion of each of the flexible engaging pieces 20. Retainer insertion direction restricting arms 23 which are formed to be elongated in parallel with the elongation direction of the flexible engaging pieces 20 and to be inserted into the retainer guide grooves 16 are formed integrally with the right and left rising portions 19, respectively. The vertical width A of the retainer insertion direction restricting arms 23 is substantially equal to the vertical width B of the retainer guide grooves 16 formed in the connector housing 11. Namely, the sizes of the arms are set so that, when each of the retainer insertion direction restricting arms 23 is inserted into the corresponding retainer guide groove 16, upper and lower guided faces 23A and 23B of the retainer insertion direction restricting arm 23 are slidingly guided by the upper and lower guiding faces 16A and 16B of the retainer guide groove 16, respectively.

On each of the rising portions 19, formed is an engagement claw 24 which is to be engaged with corresponding one of the provisional engagement grooves 17 formed in the connector housing 11 to prevent the retainer 12 inserted into the connector housing 11 at the provisional engagement position of the retainer, from slipping off therefrom. The reference numeral 25 denotes an engagement claw which protrudes from the outer lower face of the lateral bar portion 18, and which is engaged with the retainer 12 that is safely inserted into the connector housing 11, to prevent the retainer from being disengaged from the connector housing 11.

The embodiment is configured as described above. Next, the function of the embodiment will be described. At shipment or the like of the connector housing 11, first, the retainer 12 is preset with respect to the connector housing 11. The retainer 12 is preset with respect to the connector housing 11 in the following manner. The retainer 12 is inserted into the connector housing 11 so that the engaging pieces 20 formed on the retainer 12 are inserted through the rear opening of the connector housing 11 into the terminal housing chambers 14 formed in the connector housing 11, respectively.

Figure 4:
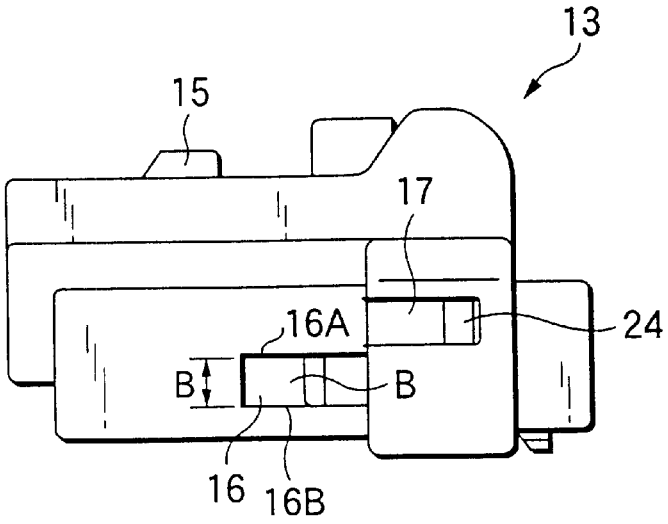
FIG. 4 is a side view showing the embodiment of the connector structure according to the invention.
Figure 5:
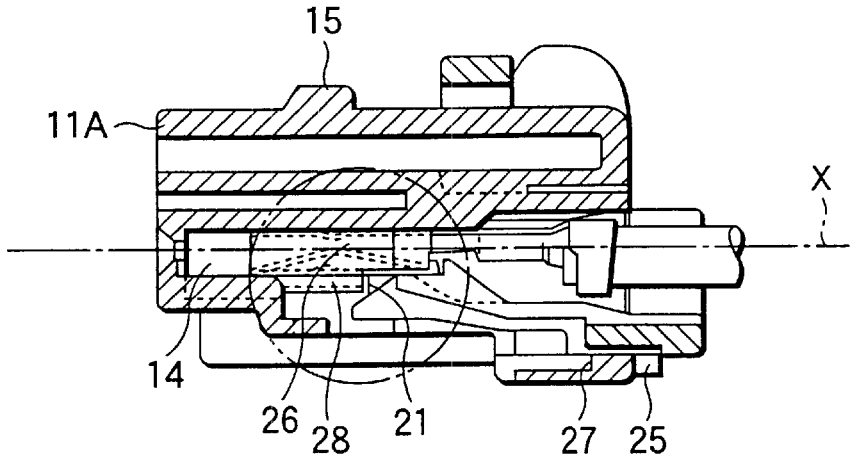
FIG. 5 is a section taken along the line V—V in Fig. 3.

When the retainer 12 is to be inserted into the connector housing 11 as described above, the retainer insertion direction restricting arms 23 formed on both the sides of the retainer 12 are guided in the retainer guide grooves 16 formed in the connector housing 11, respectively, thereby allowing the upper and lower guided faces 23A and 23B of the retainer insertion direction restricting arms 23 to be inserted in parallel with the axial direction of the connector housing 11 while being slidingly guided by the upper and lower guiding faces 16A and 16B of the retainer guide grooves 16 formed in the connector housing 11. Therefore, the retainer 12 can be inserted to the preset position in a correct direction or without being inclined in the connector housing 11. As shown in FIGS. 4 and 5, the retainer 12 which is inserted to the preset position in the correct insertion direction is prevented from slipping off from the connector housing 11, by the engagement function between the provisional engagement grooves 17 of the connector housing 11 and the engagement claws 24 of the retainer 12. The preset position of the retainer 12 is ensured without causing the retainer to be further inserted into the connector housing 11, by the engagement function between the engagement claw 25 disposed on the lower side face of the retainer 12 and the edge of the rear opening of the connector housing 11.

Then, connecting terminals 26 are inserted into the terminal housing chambers 14 of the connector housing 11 in which the retainer is preset, respectively. After the insertion of all the connecting terminals 26 is completed, the retainer 12 is further pushed into the connector housing 11 by an external pushing force which is larger than the engagement force between the engagement claw 25 of the retainer 12 which is in the preset state, and the opening of the connector housing. Then, the engagement claw 25 slides over the opening edge of the connector housing 11, and is engaged with an inner engagement edge 27 of the connector housing 11, to set the retainer 12 to a complete insertion state.

At this time, each of the terminal engagement portions 21 formed on the retainer 12 abuts against an engagement step 28 of corresponding one of the connecting terminals 26, so that the connecting terminal 26 is pushed to the regular position and prevented from slipping off.

Figure 9A:
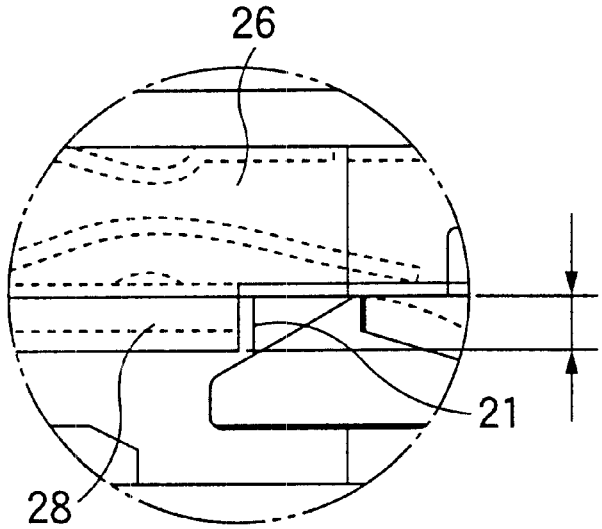
FIG. 9A shows a regular engagement state of enlarged views of an engagement portion of a connecting terminal and a retainer in the circle of FIG. 5.
Figure 9B:
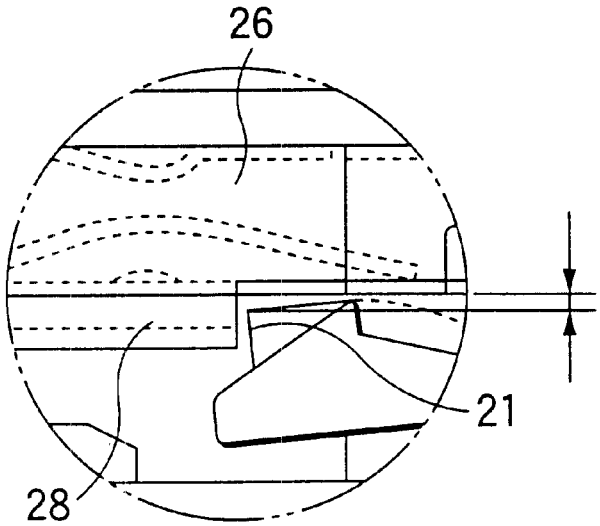
FIG. 9B shows an irregular engagement state thereof.
Figure 10:
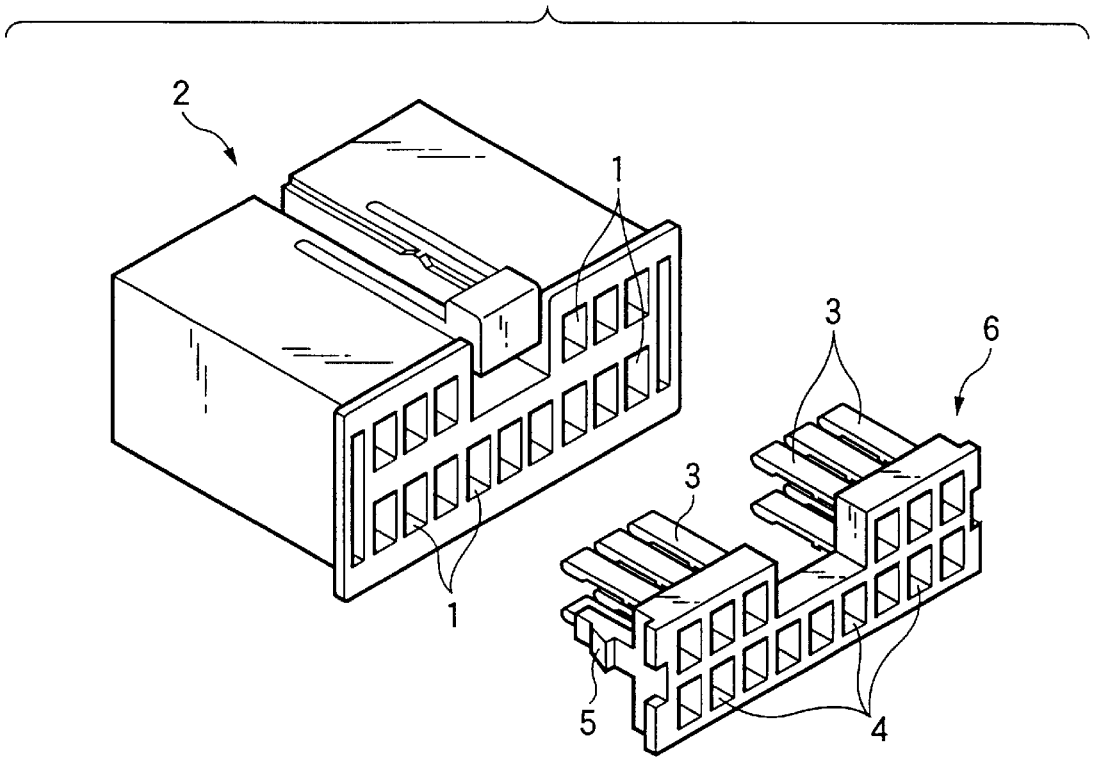
FIG.10 PRIOR ART
FIG. 10 is a perspective view showing relationships between a connector housing and a retainer in the conventional art.
Figure 11:
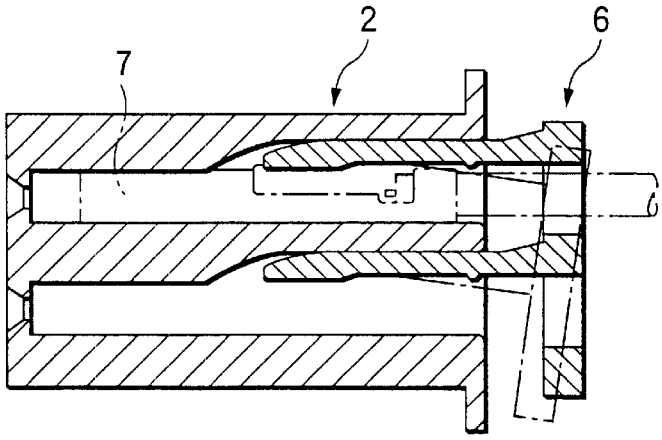
FIG.11 PRIOR ART
FIG. 11 is a section view showing a state where the connector housing and the retainer in the conventional art are half fitted to each other.

As described above, according to the terminal engagement structure of the embodiment, the insertion direction of the retainer 12 which is being inserted into the connector housing 11 from the rear opening is restricted so as to coincide with the regular insertion direction with respect to the connector housing 11, by the sliding contacting function between the retainer guide grooves disposed in the connector housing 11, and the retainer insertion direction restricting arms 23 disposed on the retainer 12. Therefore, each of the terminal engagement portions 21 disposed on the retainer 12 does not cause positional misalignment with respect to the engagement step 28 of the corresponding connecting terminal 26 such as shown in FIG. 9B, and, as shown in FIG. 9A, the terminal engagement portion 21 and the engagement step 28 are correspondingly positioned at the regular position. As a result, the connecting terminal is surely prevented by the terminal engagement portion 21 from slipping off.

The margin for fitting contact between the connector housing 11 and the retainer 12 is ensured by both the side faces of the connector housing. Therefore, the connector housing 11 and the retainer 12 are not increased in axial dimension, and hence the connector can be miniaturized.

As described above, according to the terminal engagement structure of the invention, the insertion direction of the retainer which is to be inserted into the connector housing is restricted effectively and surely without increasing the size of the connector, and hence connecting terminals inserted into the connector housing are surely prevented by the retainer from slipping off.

What is claimed is:

1. A terminal engagement structure for a connector, comprising:

a connector housing including a terminal housing chamber into which a connecting terminal is to be inserted in a connector terminal insertion direction; and a retainer insertable into the connector housing in a retainer inserting direction being same as the connector terminal insertion direction, the retainer positionable at a provisional engagement position and a regular engagement position with respect to the connector housing, wherein the retainer includes:

a retainer insertion direction restricting arm having two guided faces; and a terminal engagement portion for preventing the connecting terminal, which is provisionally inserted into the terminal housing chamber of the connector housing when the retainer is provisionally positioned with respect to the connector housing, from slipping off from the terminal housing chamber;

wherein the connector defines a retainer guide groove in a side wall of the connector housing, the retainer guide groove having two guiding faces arranged in parallel with the retainer inserting direction and opposed to each other; and wherein the guided faces of the retainer insertion direction restricting arm are guided in the retainer guide groove while being in sliding contact with the opposing guiding faces of the retainer guide groove respectively when the retainer is inserted into the connector housing.

2. The terminal engagement structure as claimed in claim 1, wherein the retainer includes two retainer insertion direction restricting arms each having two guided faces; and the connector defines two retainer guide grooves each having two guiding faces.

3. The terminal engagement structure as claimed in claim 1, wherein the retainer guide groove is disposed in an inner side face of the side wall of the connector housing.

* * * * *